US006452466B1

(12) United States Patent
Henningsson et al.

(10) Patent No.: US 6,452,466 B1
(45) Date of Patent: Sep. 17, 2002

(54) FASTENER MEANS RELATING TO CONTACT JUNCTIONS

(75) Inventors: Bo Uno Egon Henningsson, Haninge; Kristina Maria Agneta Prag, Sollentuna, both of (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/465,771

(22) Filed: Dec. 17, 1999

(30) Foreign Application Priority Data

Dec. 18, 1998 (SE) ..... 9804425

(51) Int. Cl.[7] ..... H01P 7/04
(52) U.S. Cl. ..... 333/222; 333/224; 333/206
(58) Field of Search ..... 333/222, 223, 333/224, 225, 226, 206, 203

(56) References Cited

U.S. PATENT DOCUMENTS 2,516,056 A * 7/1950 Keizer ..... 333/203
2,594,037 A * 4/1952 Landon et al. ..... 333/203
3,703,689 A * 11/1972 McAtee ..... 333/223
3,747,032 A * 7/1973 Hall et al. ..... 332/130
4,255,729 A * 3/1981 Fukasawa et al. ..... 333/202
5,008,956 A * 4/1991 Hemmie ..... 455/318
5,543,758 A * 8/1996 Wey ..... 333/203
5,691,675 A * 11/1997 Hatanaka ..... 333/202
5,932,522 A * 8/1999 Bell et al. ..... 505/210
6,114,928 A * 9/2000 Smith ..... 333/202

FOREIGN PATENT DOCUMENTS

JP 8-195607 12/1998

* cited by examiner

*Primary Examiner*—Robert Pascal
*Assistant Examiner*—Stephen E. Jones
(74) *Attorney, Agent, or Firm*—Burns, Doane, Swecker & Mathis, L.L.P.

(57) ABSTRACT

The present invention relates to a fastener means for securing a center conductor (23) in a cavity filter and for enabling the center conductor to be secured mechanically in a stable fashion and with good electric contact between itself and the bottom 22 of the cavity. The inventive fastener means comprises a center conductor and a fastener element (25, 26) provided integral therewith to form a single-piece structure, which structure may have the form of a screw with the center conductor (23) as the screw head at one end and screw threads (26) at the other end. The contact surface between the fastener means and the cavity bottom is surface-treated with a material of low resistivity, such as silver for example.

13 Claims, 3 Drawing Sheets

FASTENER MEANS RELATING TO CONTACT JUNCTIONS

FIELD OF INVENTION

The present invention relates to means for fastening a centre conductor in a cavity filter.

BACKGROUND OF THE INVENTION

When constructing and manufacturing high-frequency filters for radio base stations, the filters are built-up to form so-called cavity filters that consist of a plurality of cavities, either with a separate centre conductor in each cavity or with more than one centre conductor per cavity. These filters are used, for instance, in base stations for GSM-based mobile telephony at the frequencies of 900 MHz and 1800/1900 MHz.

Each cavity and its center conductor/conductors functions as an electric oscillating circuit that can be represented by a parallel oscillation circuit having an inductive part L and a capacitive part C when the filter is tuned to a quarter wavelength of the received signal. The inductive part is determined essentially by the length of the centre conductor, while the capacitive part is determined essentially by the diameter of the centre conductor and its distance from the cavity side walls and a trimming plate provided on the cavity. When dimensioning a cavity filter, the filter frequency determines the length of the centre conductor principally at $\lambda/4$. However, $f \sim 1/LC$ applies with respect to the inductance and capacitance of the oscillating circuit. Thus, the inductive part, and consequently the length of the centre conductor, can be reduced at a given frequency, by correspondingly increasing the capacitive part. The oscillations in a cavity generate an electromagnetic field that induces current in an adjacent cavity so that oscillation will also occur therein, therewith enabling the precise oscillation frequency to be adjusted with the aid of the trimming plate. It is evident from this that high requirements must be placed on the centre conductor with respect to its construction and with respect to the manner in which it is mounted in the cavity bottom.

The electric currents induced in the cavity flow along the length of the centre conductor and cross the cavity bottom and up along the sides of the cavity. In the case of a construction of this nature, the current is greatest at the junction between the centre conductor and the cavity bottom. At the high frequencies concerned, surface effects occur that cause the current to be conducted essentially closest to the surface. The high current and the reduction in the cross-sectional area for current conduction caused by said surface effects also results in an increase in temperature at the contact surface. This results, in turn, in mechanical stresses caused by the various states of the material at elevated temperatures. It is therefore necessary for the mutually contacting surfaces of the centre conductor and the cavity bottom to exhibit good contact properties. This is achieved by working the contact surfaces in a manner which will ensure that a high degree of flatness or planarity is obtained, preferably with the aid of a material that has good electrical conductivity, and by producing the centre conductor from a material whose coefficient of linear expansion is the same as that of the cavity-defining body, so as to provide a positive and reliable electrical contact junction even at elevated temperatures.

It will be evident from the aforegoing that one important aspect of the function of the cavity filter is that the filter will fit effectively between the centre conductor and the cavity bottom. This implies both a stable mechanical attachment and a good electric contact. It must be possible to mount and center the centre conductor in the cavity bottom very precisely and, at the same time, in the simplest possible manner.

An example of an earlier known method of connecting a centre conductor to a cavity filter is shown in FIG. 1. FIG. 1 is a cross-sectional illustration of a centre conductor 13 disposed in a cavity defined by a body 11 and having a bottom 12. In this known solution, the centre conductor 13 is hollow so that it can be screwed to the cavity bottom 12 by means of a screw 14 that is inserted through respective openings in the bottom surface of the centre conductor and the cavity bottom. The electrical junction between the center conductor and the cavity bottom consists of the bottom surface of the centre conductor that lies around the screw.

SUMMARY OF THE INVENTION

The present invention addresses the problem of providing better means for fastening a centre conductor in a cavity filter.

A first object of the present invention is to provide between the centre conductor and the cavity bottom a junction that includes a surface which has good physical and electrical contact properties so as to be able to obtain at the junction location a low impedance which also includes a low resistance.

Another object of the present invention is to provide a centre conductor that can be easily mounted and that fulfils the high precision requirements concerning its seating on the cavity bottom and also the aforesaid electrical contact properties at the junction location between the centre conductor and the cavity bottom.

These objects are achieved in accordance with the invention with the aid of fastener means that is integral with the centre conductor, such that the fastener means and said centre conductor form a single-piece structure. The contact surface between the centre conductor and the cavity bottom will preferably be surface-treated with a material of low resistivity.

A first advantage afforded by the inventive arrangement resides in stable mechanical attachment of the centre conductor and good electrical contact between the centre conductor and the cavity bottom, and also that accurate mounting of the centre conductor is facilitated.

A second advantage afforded by the inventive arrangement is that the centre conductor and its integrated fastener means can be manufactured in the same manner as a traditional screw for instance, which is a well known manufacturing technique. The manufacturing costs are thus relatively low.

The invention will now be described in more detail with reference to preferred embodiments thereof and also with reference to the accompanying drawings.

DESCRIPTION OF PREFERRED EMBODIMENTS

Figure 2:
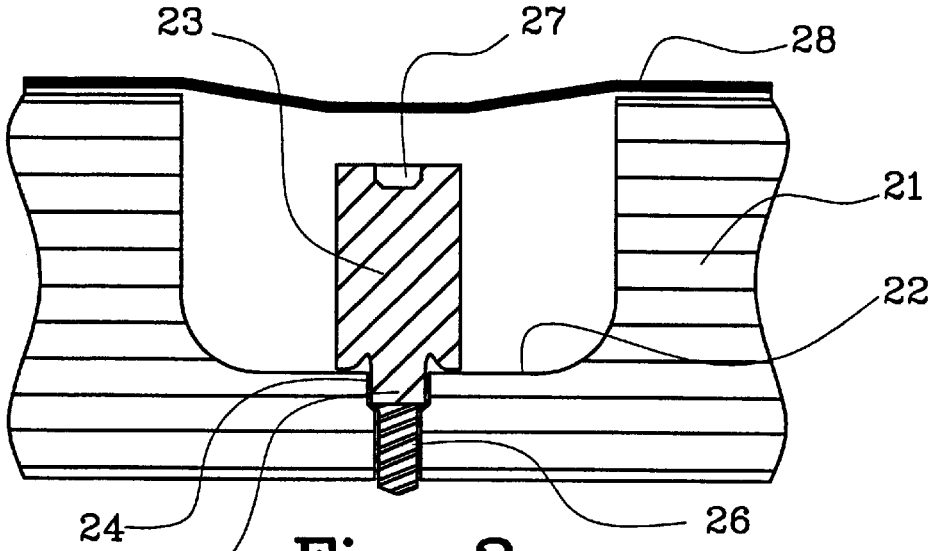
FIG. 2 illustrates a centre conductor according to a first embodiment of the present invention mounted in a cavity filter and fastened with the aid of an inventive fastening means.

FIG. 2 is a cross-sectional view of a first embodiment of a cavity-mounted centre conductor constructed in accordance with the invention. In the illustrated case, the cavity filter is comprised of a body 21 having a cavity bottom 22 which includes a guide 24 for the centre conductor 23. The centre conductor 23 is formed integrally with a fastener means which in the illustrated case comprises a screw-part 25 and associated threads 26 adapted to the guide 24. The upper side of the centre conductor is recessed at 27 to enable the use of an appropriate screwdriver. The cavity is covered with a trimming plate 28.

A particular characteristic feature of the present invention is that the centre conductor 23 and the fastener means 25, 26 are included in a single-piece structure. However, various alternative designs are conceivable within the concept of the invention. These alternatives are mainly concerned with the configuration of the centre conductor and the fastener means, and also with the way in which the centre conductor is fastened and to the arrangement at the cavity bottom 22.

Figure 3:
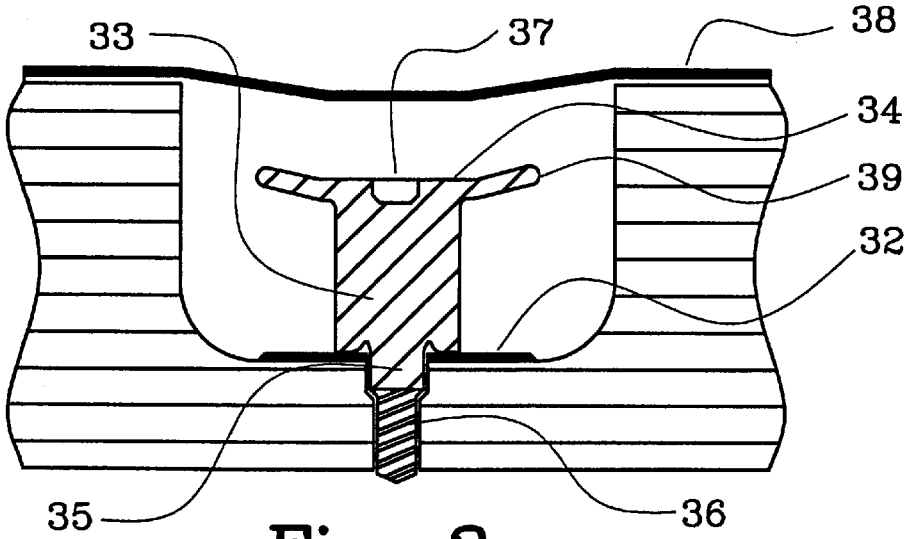
FIG. 3 illustrates an alternative embodiment of the centre conductor and cavity bottom.

For instance, the shape of the centre conductor is not solely limited to a cylindrical shape, as in the case of the FIG. 2 embodiment, but can be varied in accordance with the properties desired of the filter. FIG. 3 shows a conceivable modification of the centre conductor 33, where the surface area 34 proximal to the trimming plate 38 is greater than the general cross-sectional area of the centre conductor so as to raise the capacitance of the oscillating circuit between centre conductor 23 and trimming plate 38. Another modification is one in which the surface area of the upper part 34 of the centre conductor proximal to the trimming plate 38 is greater than the cross-sectional area of the centre conductor in general and in which the surface area of the upper part 39 proximal to both side walls of the cavity is enlarged and the distance therefrom to said side walls reduced so as to obtain a higher capacitance. The upper side of the centre conductor is recessed at 37 for the use of an appropriate screwdriver. As mentioned above, high demands are placed on the flatness of the bottom surface of the cavity. Accordingly, FIG. 3 shows the option of allowing the centre conductor to be placed on a slightly elevated groove 32, said groove in particular having been worked to a high degree of flatness.

The fastener means of the embodiments according to FIG. 2 and FIG. 3 are provided with screw threads 26, 36, either completely or partially. Preferably, the electrical contact is obtained by inserting the centre conductor in a guide provided in the cavity bottom, by turning or screwing-down the fastener means in a manner to achieve cold welding of the material at the mutually contacting surfaces of the centre conductor and the cavity bottom. Electrical contact at the current junction can, however, be improved by surface-treating the centre conductor and the cavity bottom with a material of low resistivity, such as silver for instance. When fastening the centre conductor there will be obtained in this way cold welding of the surface treatment material such as to establish a very low contact resistance between centre conductor and cavity bottom. It is thus with this type of fastening that the centre conductor, according to the invention, can be used very advantageously for obtaining good electrical contact by cold-welding and by using a beneficial surface treatment material. Naturally, it is also possible to fasten the inventive arrangement with the aid of some other temperature-based contacting procedure or by an appropriate contact pressing procedure.

Figure 1:
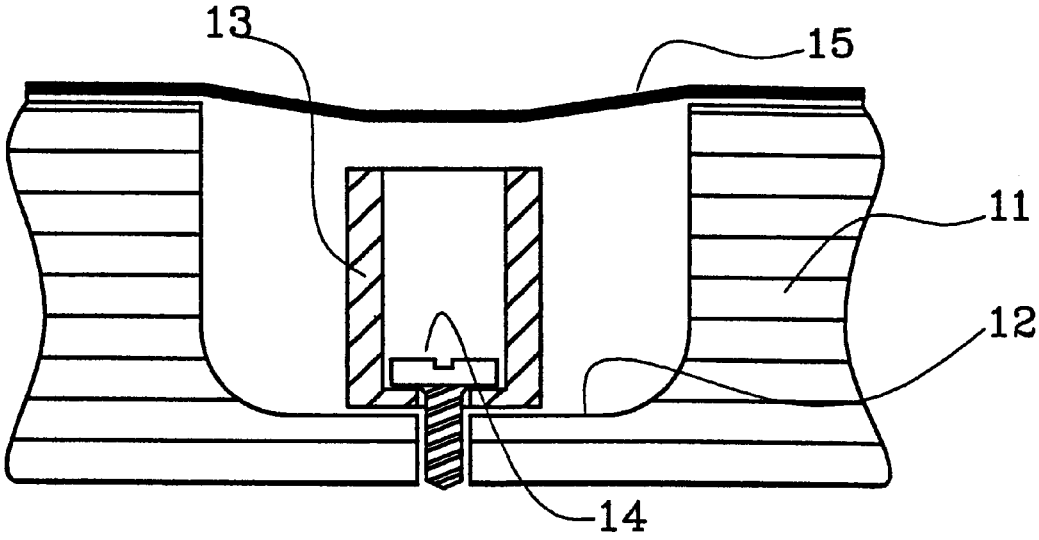
Fig. 1 Prior Art
FIG. 1 illustrates a known means of fastening a centre conductor in a cavity.

FIGS. 2 and 3 show the most beneficial design of the centre conductor at the actual place where electrical contact is established with the cavity bottom, i.e with a smaller abutment surface against the cavity bottom. This abutment surface may, however, be slightly larger, such as in the case of the FIG. 1 illustration.

Figure 4:
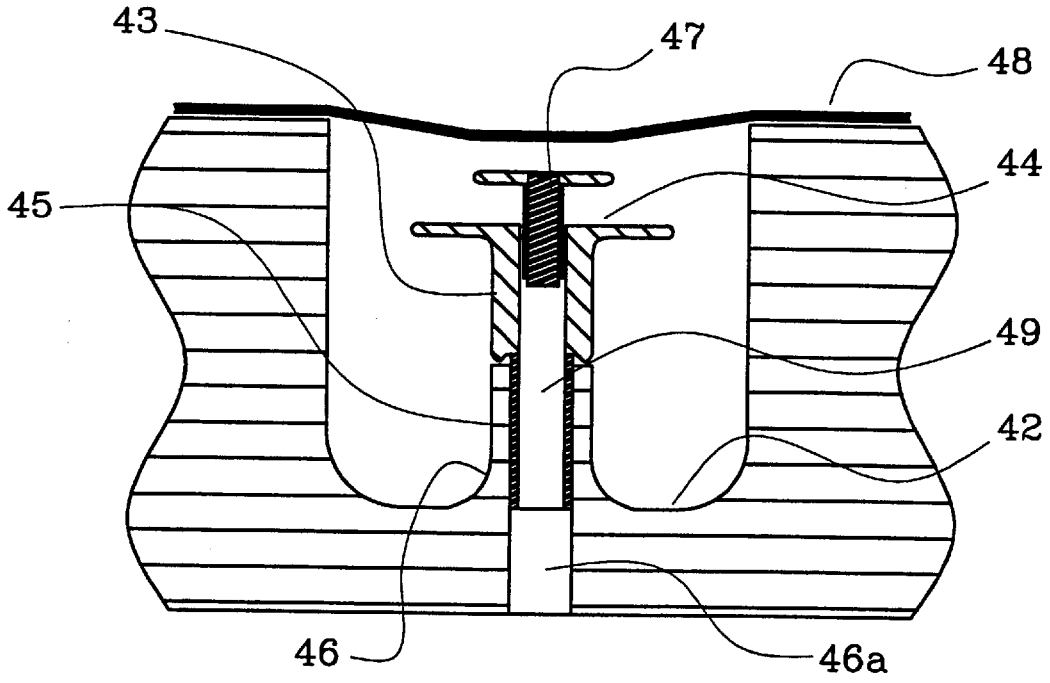
FIG. 4 illustrates a centre conductor according to a second preferred embodiment of the present invention mounted in a cavity filter and fastened with the aid of an inventive fastening means.

FIG. 4 shows a second preferred embodiment of the cavity-mounted centre conductor according to the present invention. The centre conductor 43 is formed integrally with a fastener means comprising a screw-part 45 with associated threads. The surface 44 proximal to the trimming plate 48 is preferably designed greater than the general cross-sectional area. In this embodiment, the centre conductor is designed with a hollowness 49 through its entire length along with its centre axis whereby at least the upper part of said hollowness is designed with threads such that an additional trimming element 47, e.g. a screw, can be adjustable fastened in the upper part of the centre conductor 43. The centre conductor 43 can be mounted directly on the bottom 42 of a cavity filter or on a slightly elevated groove on said bottom that has been worked to a high degree of flatness. The centre conductor 43 can also be mounted, as shown in FIG. 4, on a cylindrical part 46 that forms an integral part of the cavity filter and raises from the cavity bottom 42. Said cylindrical part 46 is designed with a hollowness 46*a* and threads through its entire length within which the centre conductor is screwed in.

The centre conductor is produced mainly by machining brass in a lathe, while the cavity is normally formed in an aluminium or magnesium body, for instance. The material from which the centre conductor is made must fulfil certain requirements. A suitable material is one that can be easily worked to produce the aforesaid center conductor configurations with high precision. The material must also be light in weight, so as not to increase the weight of the filter more than necessary. Above all, the centre conductor must consist of a material that has a coefficient of linear expansion equivalent to that of the cavity body, so that temperature increases caused by the high currents at the contact junction will not impair the contact. These requirements are fulfilled to a great extent by aluminium or magnesium for instance, although brass may also conveniently be used.

It will be understood that the invention is not restricted to the aforedescribed and illustrated exemplifying embodiments thereof and that modifications can be made within the scope of the following Claims.

What is claimed is:

1. Fastener means for securing a centre conductor in a cavity filter, wherein said means includes:

a threaded insertion element which is integral with the centre conductor and narrower than said centre conductor and which fastens the centre conductor with the outer edge of said centre conductor resting on the bottom of said cavity, wherein the centre conductor is fastened to the bottom of the cavity without a threaded nut, and as a result of turning or screwing the insertion element into an opening provided in the bottom of the cavity, such as to achieve cold welding of the mutually facing contact surfaces.

2. Fastener means according to claim 1, wherein the insertion element is comprised totally or partially of a threaded screw whose external thread is intended to be screwed firmly into the cavity bottom.

3. Fastener means according to claim 2, wherein the upper side of the centre conductor is recessed for receiving an appropriate screwdriver.

4. Fastener means according to claim 2, comprising:

a hollowness through an entire length of the centre conductor, whereby at least the upper part of said hollowness is designed with threads such that an additional trimming element can be adjustably fastened in said upper part.

5. Fastener means according to claim 1, wherein the cavity bottom and the underside of the centre conductor are surface-treated with a material of low resistivity.

6. Fastener means according to claim 5, wherein said surface treatment material is silver.

7. Fastener means for securing a centre conductor in a cavity filter, the cavity filter including a body having a cavity bottom, wherein the fastener means comprising:

an insertion element which is integral with the centre conductor and narrower than the centre conductor, wherein the insertion element includes a threaded screw, wherein a portion of the threaded screw mates with an inner surface of the cavity bottom, and wherein the insertion element fastens an outer edge of the centre conductor to the cavity bottom without a threaded nut.

8. The fastener means of claim 7, wherein an upper side of the centre conductor is recessed.

9. The fastener means of claim 7, wherein the cavity bottom and an underside of the centre conductor are surface-treated with a material of low resistivity.

10. The fastener means of claim 7, wherein only a portion of the insertion element includes the threaded screw, wherein when the outer edge of the centre conductor is fastened to the cavity bottom, a portion of the insertion element which does not include the threaded screw abuts the inner surface of the cavity bottom.

11. Fastener means for securing a centre conductor in a cavity filter, the cavity filter including a body having a cavity bottom, wherein the fastener means comprising:

an insertion element which is integral with the centre conductor and narrower than the centre conductor, wherein the insertion element includes a threaded screw, wherein a portion of the threaded screw mates with an inner surface of the cavity bottom to secure the center conductor to the cavity bottom without a threaded nut.

12. The fastener means of claim 11, wherein only a portion of the insertion element includes the threaded screw, wherein when an outer edge of the centre conductor is fastened to the cavity bottom, a portion of the insertion element which does not include the threaded screw abuts the inner surface of the cavity bottom.

13. The fastener means of claim 11, wherein an upper side of the centre conductor is recessed.

* * * * *